US009423086B2

(12) United States Patent
Peck et al.

(10) Patent No.: US 9,423,086 B2
(45) Date of Patent: Aug. 23, 2016

(54) LED SIGNAL LIGHT WITH VISIBLE AND INFRARED EMISSION

(75) Inventors: John Patrick Peck, Manasquan, NJ (US); Kevin A. Hebborn, Toms River, NJ (US)

(73) Assignee: Dialight Corporation, Farmingdale, NJ (US)

( * ) Notice: Subject to any disclaimer, the term of this patent is extended or adjusted under 35 U.S.C. 154(b) by 0 days.

(21) Appl. No.: 13/328,001

(22) Filed: Dec. 16, 2011

(65) Prior Publication Data

US 2013/0155705 A1 Jun. 20, 2013

(51) Int. Cl.

| | |
|---|---|
| ***H05B 37/00*** | (2006.01) |
| ***H05B 37/02*** | (2006.01) |
| ***F21S 8/00*** | (2006.01) |
| ***H05B 33/08*** | (2006.01) |
| ***F21V 7/00*** | (2006.01) |
| ***F21V 7/06*** | (2006.01) |
| *F21W 111/06* | (2006.01) |
| *F21Y 101/02* | (2006.01) |
| *F21V 5/04* | (2006.01) |

(52) U.S. Cl.

CPC . *F21S 8/00* (2013.01); *F21V 7/005* (2013.01); *F21V 7/0058* (2013.01); *F21V 7/06* (2013.01); *H05B 33/083* (2013.01); *H05B 33/0827* (2013.01); *F21V 5/043* (2013.01); *F21W 2111/06* (2013.01); *F21Y 2101/02* (2013.01)

(58) Field of Classification Search

CPC ..... F21Y 2113/00–2113/02; H05B 33/0803–33/0896; F21K 9/00–9/90

See application file for complete search history.

(56) References Cited

U.S. PATENT DOCUMENTS

| | | | | |
|---|---|---|---|---|
| 4,912,334 | A | 3/1990 | Anderson | |
| 6,456,205 | B1 * | 9/2002 | Russell et al. | 340/815.45 |
| 6,949,772 | B2 * | 9/2005 | Shimizu et al. | 257/99 |
| 7,645,053 | B2 * | 1/2010 | Machi et al. | 362/241 |
| 7,804,251 | B2 * | 9/2010 | Wang | 315/133 |
| 2006/0007012 | A1 | 1/2006 | Machi et al. | |
| 2009/0115663 | A1 | 5/2009 | Brown et al. | |
| 2009/0190362 | A1 | 7/2009 | Peck et al. | |
| 2011/0121734 | A1 | 5/2011 | Pape | |

FOREIGN PATENT DOCUMENTS

| | | |
|---|---|---|
| GB | 2337645 A | 11/1999 |
| WO | WO 2009/084049 | 7/2009 |

OTHER PUBLICATIONS

International Search Report and Written Opinion for PCT/US2012/069809, Feb. 26, 2013, consists of 9 pages.

European Search Report dated Aug. 27, 2015 in corresponding EP 12 85 6672.6, pp. 1-7.

* cited by examiner

*Primary Examiner* — Mariceli Santiago

(57) ABSTRACT

The present disclosure is directed to a light emitting diode (LED) signal light. In one embodiment, the LED signal light includes at least one visible LED, at least one infrared (IR) LED, a reflector, wherein the reflector collimates a light emitted from the at least one visible LED and a light emitted from the at least one IR LED and a power supply powering the at least one visible LED and the at least one IR LED.

13 Claims, 11 Drawing Sheets

LED SIGNAL LIGHT WITH VISIBLE AND INFRARED EMISSION

BACKGROUND

A beacon light such as, for example, an aircraft obstruction light, can be used to mark an obstacle that may provide a hazard to aircraft navigation. Beacon lights are typically used on buildings, towers, and other structures taller than about 150 feet. Previous beacon lights were made using traditional light sources such as incandescent or high intensity discharge lamps. These traditional light sources emit infrared (IR) light as well as visible light making them visible to pilots with aviator night vision imaging systems (ANVIS).

However, some recent beacon lights use light sources that provide little or no light in the IR part of the electromagnetic spectrum. As a result, these types of light sources are not visible to pilots with ANVIS.

SUMMARY

In one embodiment, the present disclosure discloses a light emitting diode signal light. For example, the LED signal light includes at least one visible LED, at least one infrared (IR) LED, a reflector, wherein the reflector collimates a light emitted from the at least one visible LED and a light emitted from the at least one IR LED and a power supply powering the at least one visible LED and the at least one IR LED.

The present disclosure also provides another embodiment of the LED signal light. For example, the LED signal light includes, a plurality of reflectors, at least one visible LED associated with each one of the plurality of reflectors, at least one infrared (IR) LED associated with each one of the plurality of reflectors, wherein a respective one of the plurality of reflectors collimates a light emitted from the at least one visible LED and a light emitted from the at least one IR LED and a power supply powering the each one of the at least one visible LED associated with the each one of the plurality of reflectors and the each one of the at least one IR LED associated with the each one of the plurality of reflectors.

The present disclosure also provides yet another embodiment of a LED signal light. For example, the LED signal light includes, at least one visible LED, at least one infrared (IR) LED, a reflector cup coupled to each one of the at least one visible LED and the at least one infrared LED, wherein the reflector cup collimates light emitted from a respective one of the at least one visible LED and the at least one IR LED and a power supply for powering the at least one visible LED and the at least one IR LED.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

As discussed above, at night pilots often use aviator night vision imaging systems (ANVIS) that allow pilots to see infrared (IR) light emitted from various light sources. The IR portion of the electromagnetic spectrum may be considered to be any radiation emitted between 750 nm and 1 millimeter (mm). The visible portion of the electromagnetic spectrum may be considered to be any radiation emitted between 390 nm and 750 nm.

Recently, beacon light designs have begun to use visible light emitting diodes (LEDs). However, the LEDs emit light into only a narrow band of the electromagnetic spectrum. For example, colored LEDs typically have a full width at half maximum (FWHM) bandwidth of less than 50 nm. Therefore, some visible LEDs may emit little or no light in the IR part of the electromagnetic spectrum.

Figure 2:
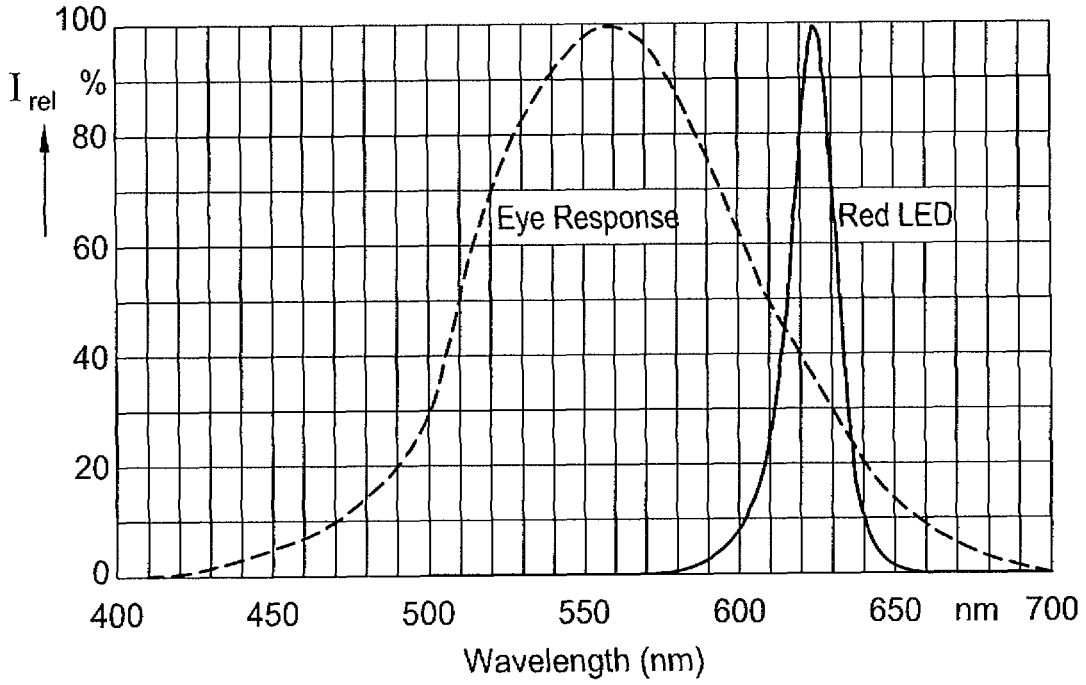
FIG. 2 depicts a graph of spectral sensitivity response of a human eye and a spectral distribution of a red LED.
Figure 3:
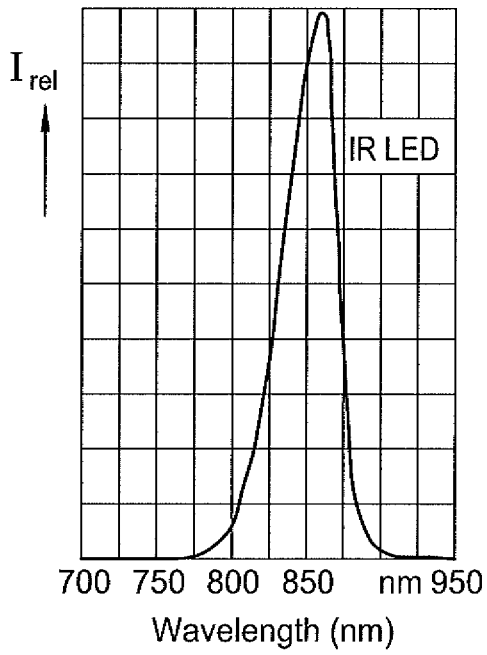
FIG. 3 depicts a graph of a power spectral distribution of an IR LED.

FIG. 2 shows the spectral sensitivity response of the human eye (Eye Response) as well as the power spectral distribution of a red LED (Red LED). For example, FIG. 2 illustrates relative intensity as a percentage against a wavelength. FIG. 3 shows the power spectral distribution of an IR LED (IR LED). For example, FIG. 3 illustrates relative intensity as a percentage against a wavelength.

The photocathodes used in night vision equipment amplify electromagnetic emission so that people can see images under very low light levels, such as for example, night time conditions. Initially, pilots had problems using night vision equipment because the cockpit lighting was much brighter than the outside lighting and, therefore, the cockpit lighting would overwhelm and saturate the night vision equipment.

This problem was solved by using filters on the night vision equipment to block visible light from entering the night vision equipment. The lighting in the cockpit also was filtered so that no IR light was emitted from the cockpit lighting. The end result is that the night vision equipment only sees the outside IR light and does not respond to anything from the cockpit lighting.

Figure 12:
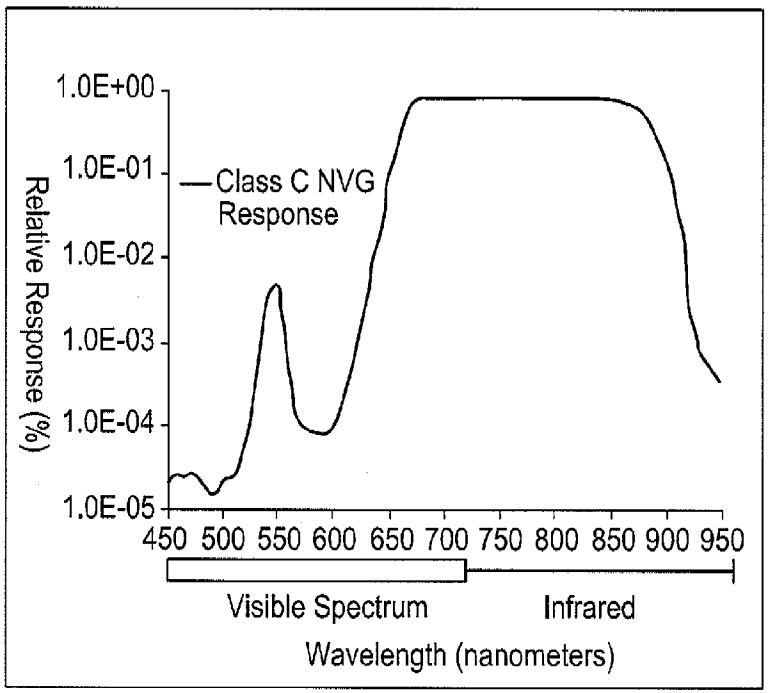
FIG. 12 depicts spectral sensitivity of Class A, Class B and Class C night vision systems.
Figure 12:
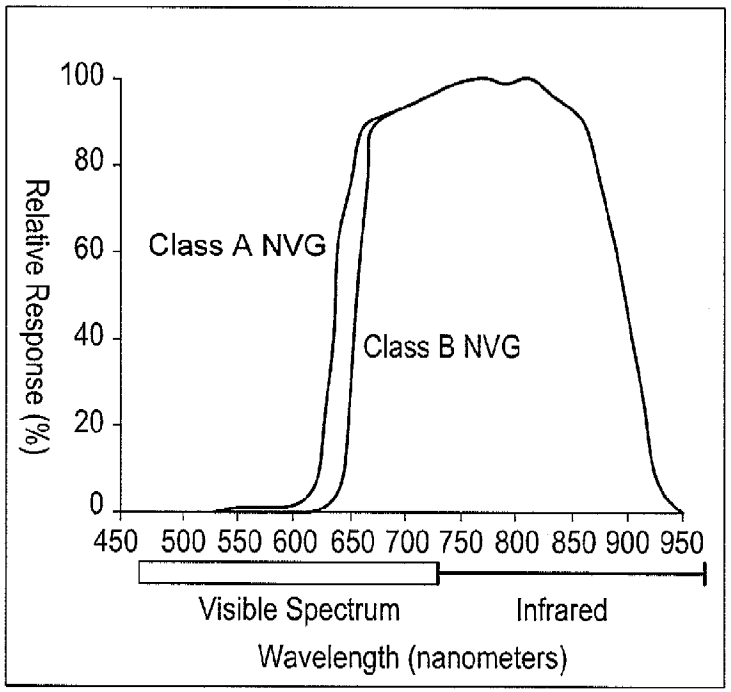

FIG. 12 shows spectral sensitivity examples of Class A, Class B and Class C night vision goggles (NVGs) or systems.

Due to the filtering, the Class A and the Class B systems show little or no response to visible light.

It should be noted that ANVIS is similar to NVGs except that ANVIS normally contain a filter to block visible light. As stated above, the ANVIS filtering is used to block visible light so that cockpit lighting does not overwhelm and saturate the goggles. As stated before, saturation would inhibit visibility of the outside view. Cockpit light filtering blocks cockpit lighting from emitting IR light.

Figure 4:
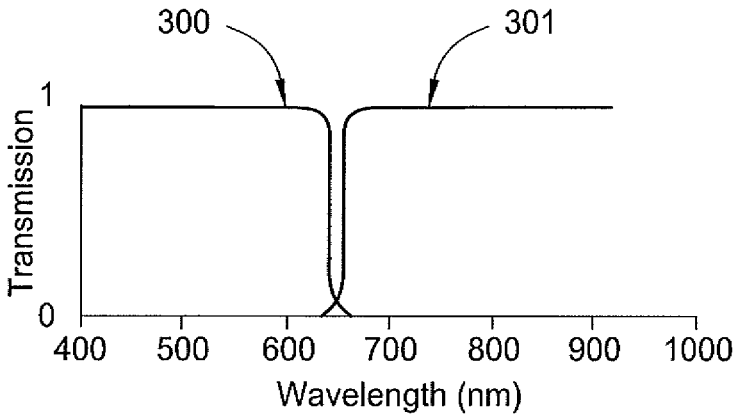
FIG. 4 depicts a graph of filter characteristics of a cockpit lighting filter and an ANVIS filter.

FIG. 4 shows a chart of transmission versus wavelength in nanometers (nm) for both the cockpit lighting filter 300 and an example ANVIS filter 301. The chart is used to visually illustrate how there is essentially no overlap.

As a result of the ANVIS filtering, signal lights that deploy LEDs may not be visible to pilots utilizing ANVIS. One solution may be to provide an additional beacon that emits just infrared light. The additional light may have a separate enclosure, power supply, and optics for the IR LEDs.

This design may not be ideal because it would require additional wiring and mounting arrangements as well. In addition, using separate power supplies may draw more power and make fault detection of the IR light more difficult. For example, IR LEDs are not visible to the naked eye so a visual check with the unaided eye would not be possible. Therefore, additional electronic monitoring would be required.

Figure 1:
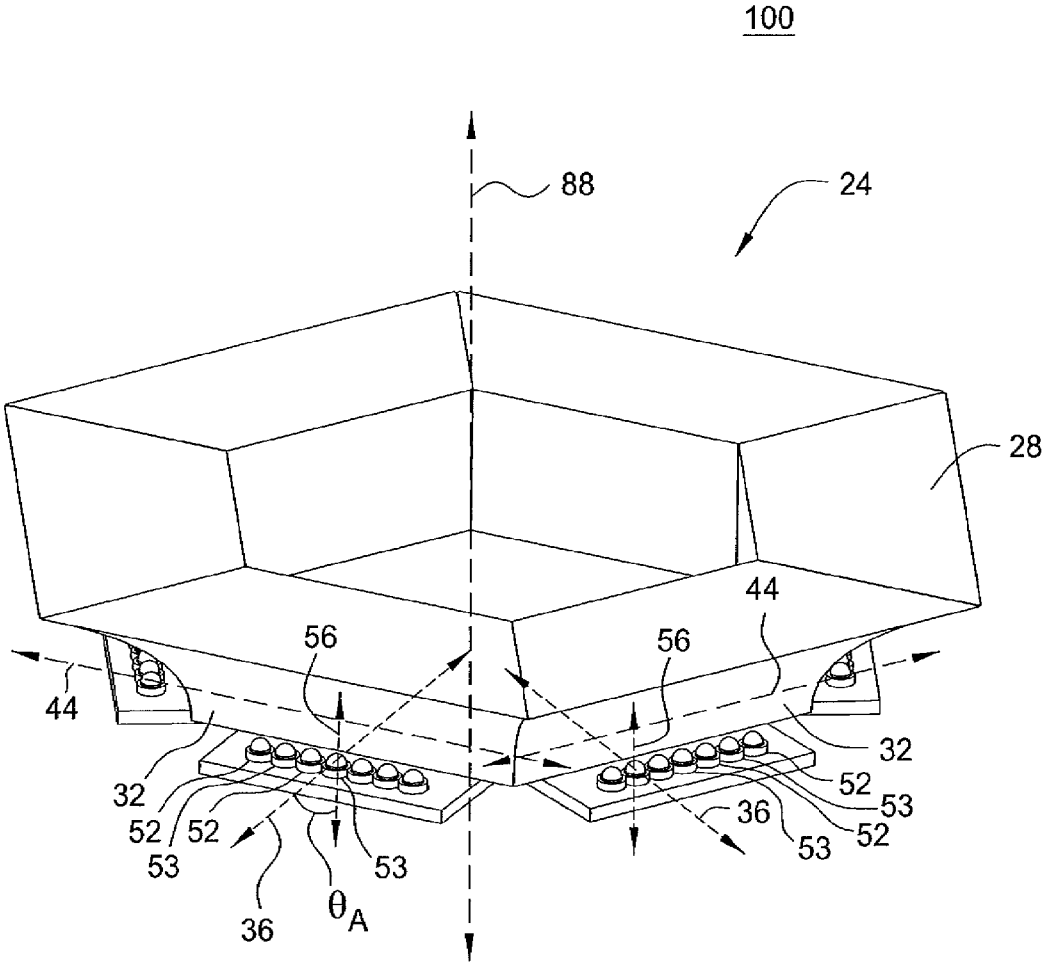
FIG. 1 depicts a perspective view of an embodiment of an LED reflector optic used for a signal light having a visible LED and an IR LED.

Embodiments of the present disclosure provide an LED signal light that utilizes both colored LEDs and IR LEDs in a more efficient design that may be powered by a common power supply and may provide simple fault detection. In one embodiment, the common power supply may be a single power supply. In another embodiment, the common power supply may be multiple power supplies configured in series. FIG. 1 depicts a perspective view of an embodiment of a signal light 100 using both visible LEDs 52 and IR LEDs 53. In one embodiment, the visible LEDs 52 may include red-orange aluminum indium gallium phosphide (AlInGaP) LEDs with a peak wavelength of between 610 to 630 nm may be used. Red-orange AlInGaP LEDs with a peak wavelength of between 610 to 630 nm may be a good choice for a beacon light since red-orange AlInGaP LEDs with a peak wavelength of between 610 to 630 nm can be made that emit very high visible luminous flux light levels compared to other colored LEDs made from AlInGaP LEDs. This may be important in a beacon light so that the power consumption can be minimized. However, it should be noted that other visible LEDs of different colors can still be used.

In one embodiment, the visible LEDs 52 may comprise red AlInGaP LEDs with a peak wavelength of between 620 to 645 nm may be used. Red AlInGaP LEDs with a peak wavelength of between 620 to 645 nm may be a good choice for a beacon light since red AlInGaP LEDs with a peak wavelength of between 620 to 645 nm can be made to have a more stable light intensity as a function of temperature compared to other colors AlInGaP LEDs. This may be important in a beacon light since a beacon with too low or too high of an intensity in the light beam may be a hazard to pilots. However, it should be noted that other visible LEDs of different colors can still be used.

In one embodiment, the visible LEDs 52 may comprise deep red AlInGaP LEDs with a peak wavelength of between 640 to 680 nm may be used. Deep red AlInGaP LEDs with a peak wavelength of between 640 to 680 nm may be a good choice for a beacon light since deep red AlInGaP LEDs with a peak wavelength of between 640 to 680 nm can provide some visibility to pilots with and without ANVIS. However, it should be noted that other visible LEDs of different colors can still be used. In one embodiment, the IR LEDs 53 may comprise an IR LED emits light with a peak wavelength at between 800 nm and 900 nm.

In one embodiment, the LED signal light 100 includes an LED reflector optic 24 comprising a plurality of segmented reflectors 28 each having a reflecting surface 32. In one embodiment, the reflecting surface 32 may comprise aluminum, silver, gold or a plastic film for reflecting light. Silver may be used to increase the reflectivity in the near infrared.

Figure 5:
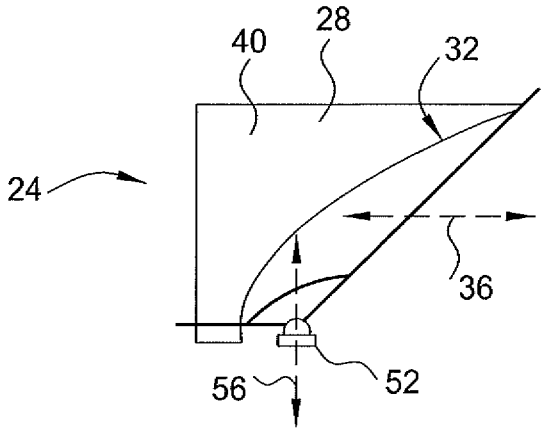
FIG. 5 depicts a partial sectional side view of an embodiment of the LED reflector optic depicted in FIG. 1.

Each reflecting surface 32 comprises a cross-section 40 (as depicted in FIG. 5) which is projected along an associated linear extrusion axis 44. In one embodiment, each reflecting surface 32 comprises a cross-section 40 which is projected along an associated curved extrusion axis. In one embodiment, the projected cross-section 40 comprises a conic section. A conic section provides an advantageous reflected light intensity distribution. In one embodiment, the cross-section 40 of the reflecting surface 32 comprises at least one of: a conic or a substantially conic shape. In one embodiment, the conic shape comprises at least one of: a hyperbola, a parabola, an ellipse, a circle, or a modified conic shape.

Each reflecting surface 32 has an associated optical axis 36. The optical axis 36 may be defined as an axis along which the main concentration of light is directed after reflecting off of the segmented reflector 28. In one embodiment, each reflecting surface 32 reflects a beam of light having an angular distribution horizontally symmetric to the associated optical axis 36, i.e. symmetric about the associated optical axis 36 in directions along the extrusion axis 44.

For each reflecting surface 32, the LED reflector optic 24 comprises at least one associated visible LED 52 and at least one associated IR LED 53. The visible LEDs 52 and the IR LEDs 53 each has a central light-emitting axis 56, and typically emits light in a hemisphere centered and concentrated about the central light-emitting axis 56. The visible LEDs 52 and the IR LEDs 53 is each positioned relative to the associated reflecting surface 32 such that the central light-emitting axis 56 of the visible LEDs 52 and the IR LEDs 53 are angled at a predetermined angle $\theta_A$ relative to the optical axis 36 associated with the reflecting surface 32. In one embodiment, $\theta_A$ has a value of about 90°. In one embodiment, the about 90° has a tolerance of ±30°, i.e., from 60° to 120°. It should be noted that other tolerance ranges may still be operable, but less efficient.

In one embodiment, for a specific reflecting surface 32 and associated visible LEDs 52 and IR LEDs 53, the central light-emitting axis 56 of the visible LED 52 or the IR LED 53, the optical axis 36 associated with the reflecting surface 32, and the extrusion axis 44 of the reflecting surface 32 form orthogonal axes of a 3-axes linear coordinate system. Namely, the central light-emitting axis 56, the optical axis 36, and the extrusion axis 44 are mutually perpendicular. In one embodiment, the mutually perpendicular relationship between the central light-emitting axis 56, the optical axis 36, and the extrusion axis 44 is approximate. For example, each of the central light-emitting axis 56, the optical axis 36, and the extrusion axis 44 can be angled at 90° from each of the other two axes, with a tolerance, in one embodiment, of ±30°.

In one embodiment, for each reflecting surface 32, the LED reflector optic 24 comprises a plurality of associated visible LEDs 52 and the IR LEDs 53. Said another way, the visible LEDs 52 and the IR LEDs 53 are associated with a common optic, e.g., the reflecting surface 32. Said yet another way, the reflecting surface 32 redirects both the visible light emitted from the visible LED 52 and the IR light or radiation emitted from the IR LED 53.

In one embodiment, the plurality of associated visible LEDs 52 and IR LEDs 53 are arranged along a common line, as depicted in FIG. 1, parallel to the extrusion axis 44 of the reflecting surface 32. In one embodiment, the plurality of associated visible LEDs 52 and IR LEDs 53 are staggered about a line. For example, in one embodiment, the plurality of associated visible LEDs 52 and IR LEDs 53 are staggered about a line, with the staggering comprising offsetting the visible LEDs 52 and IR LEDs 53 from the line by a predetermined distance in alternating directions perpendicular to the line. In one embodiment, the line may be slightly curved. Also, in one embodiment, the visible LEDs 52 and IR LEDs 53, are positioned proximate a focal distance of the reflecting surface 32. In one embodiment, proximate may be defined as having a center of the visible LEDs 52 or the IR LEDs 53 near or approximately on the focal distance. In another embodiment, proximate may be defined as having the center of the visible LEDs 52 or the IR LEDs 53 at the focal distance.

Figure 6:
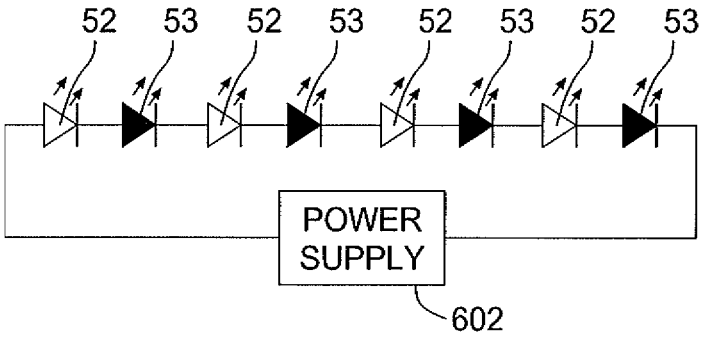
FIG. 6 depicts a block diagram of the visible LED and the IR LED connected to a single power supply in series.

In one embodiment, the visible LEDs 52 and IR LEDs 53 are powered by a common power supply. In one embodiment, the common power supply may be a single power supply. In another embodiment, the common power supply may be multiple power supplies configured in series. FIG. 6 illustrates one embodiment of the visible LEDs 52 and the IR LEDs 53 electrically connected in series and powered by a common power supply 602. In one embodiment, the visible LED 52 and the IR LED 53 may be placed in an alternating fashion.

Figure 7:
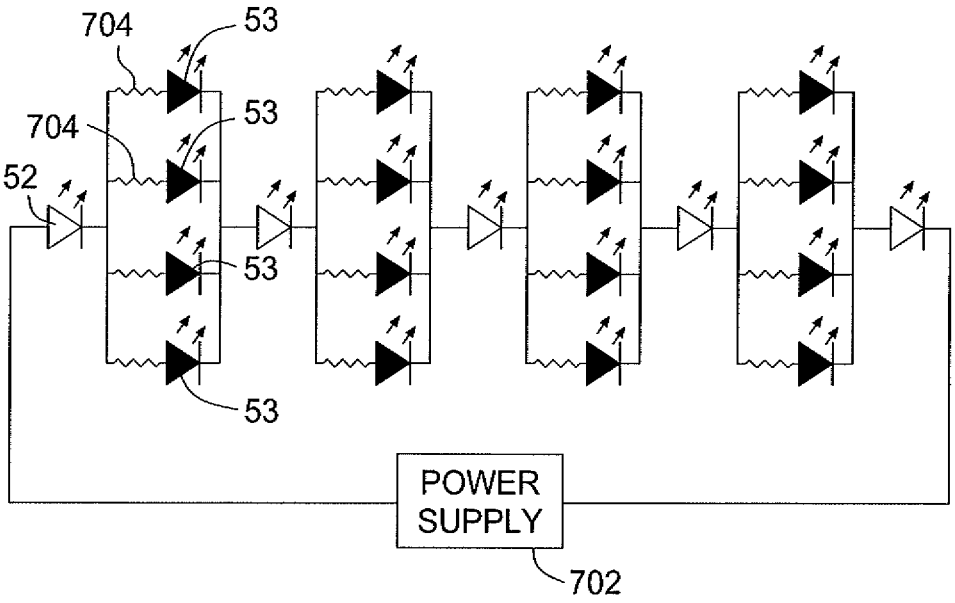
FIG. 7 depicts a block diagram of the visible LED and the IR LED connected to a single power supply in a series/parallel configuration.

In another embodiment, due to the different current requirements of the visible LED 52 and the IR LED 53, the visible LEDs 52 and the IR LEDs 53 may be operated in a series-parallel configuration as illustrated in FIG. 7 with a common power supply 702. For example, the IR LEDs 53 may be operated in parallel while connected to the visible LED 52 in series such that the visible LEDs 52 and the IR LEDs 53 operate at different currents. The current to each IR LED 53 will be less than the current to each visible LED 52 if two or more IR LEDs 53 are arranged in parallel.

To ensure precise sharing of current between parallel connected LEDs, a resistor 704 may be added in series with each one of the IR LEDs 53. In the example illustrated in FIG. 7, the visible LEDs 52 receive four times the current of the IR LEDs 53. However, in principle, there is no limit to the different series/parallel combinations possible to achieve any desired division of current between the visible LEDs 52 and the IR LEDs 53.

By using a common power supply 602 or 702, the signal light 100 may use less overall power as well as the light being smaller and less expensive. In addition, the signal light 100 may provide automatic fault detection. For example, if any one of the visible LEDs 52 or the IR LEDs 53 in FIG. 6 or any one of the visible LEDs 52 or the parallel group of IR LEDs 53 in FIG. 7 fail as a high impedance, an open circuit may be detected and the LEDs 52 and 53 would stop drawing power from the power supply 602. As a result, the entire signal light 100 would stop drawing current and the fault may be easily detected visually or electrically. There would be a similar outcome in the event of complete power supply failure since no current could flow through any LED. A technician may easily detect that signal light 100 has failed and take appropriate action to remedy the situation.

Figure 8:
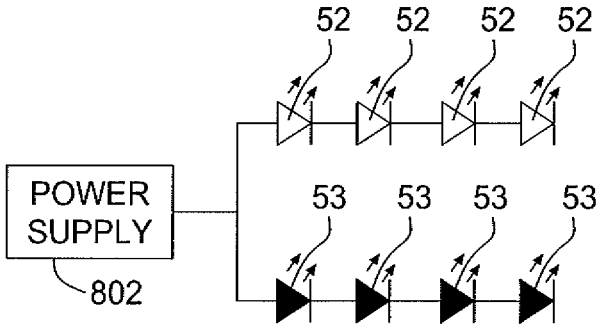
FIG. 8 depicts a block diagram of the visible LED and the IR LED connected to a single power supply in parallel.

FIG. 8 illustrates one embodiment of the visible LEDs 52 and the IR LEDs 53 electrically connected in parallel and powered by a common power supply 802. In one embodiment, one branch may include the visible LEDs 52 and another branch may include the IR LEDs 53.

In one embodiment, to provide fault detection when the visible LEDs 52 and the IR LEDs 53 are electrically connected in parallel, the visible LEDs 52 and the IR LEDs 53 may be electrically connected to a voltage sensing circuit capable of sensing the voltage drop across the LED arrangement, or across each of the visible LEDs 52 or the IR LEDs 53. In the event an LED fails as a low impedance, the resulting voltage drop can be detected in order to trigger an alarm or completely shut down the signal light 100. As a result, the signal light 100 would not emit any light and a technician may easily detect that the signal light 100 has failed.

In one embodiment, a current sensing circuit can be included to monitor the total LED current or current in one of the visible LEDs 52 and/or one of the IR LEDs 53. In the event of reduced or excessive current an alarm may be triggered or the signal light 100 may shut down. The reduced or excessive current may be determined based upon comparison to a predetermined current level.

The design of the signal light 100 provides a highly collimated signal light that uses both visible LEDs 52 and IR LEDs 53 powered by a common power supply 602. For example, the visible light emitted by the visible LEDs 52 and the IR light or radiation emitted by the IR LEDs 53 may be both collimated by the segmented reflector 28 up to plus or minus 10 degrees above or below relative to the optical axis 36. In addition, the signal light 100 provides an omni-directional light distribution, such as a 360 degree light distribution, of the highly collimated light for both the visible LEDs 52 and the IR LEDs 53.

In addition, in one embodiment, the signal light 100 utilizes reflectors rather than optical lens. In other words, the signal light 100 does not rely on optical lenses that affect the light emitted by the visible LEDs 52 or the IR LEDs 53. For example, the reflecting surface 32 may reflect and re-direct the light emitted by the visible LEDs 52 or the IR LEDs 53 equally well. However, optical lenses may have a refractive index that is different for different wavelengths of light. As a result, optical lenses may be able to properly re-direct the light emitted from the visible LED 52 well, but not be able to properly re-direct the light emitted from the IR LED 53, or vice versa.

Figure 9:
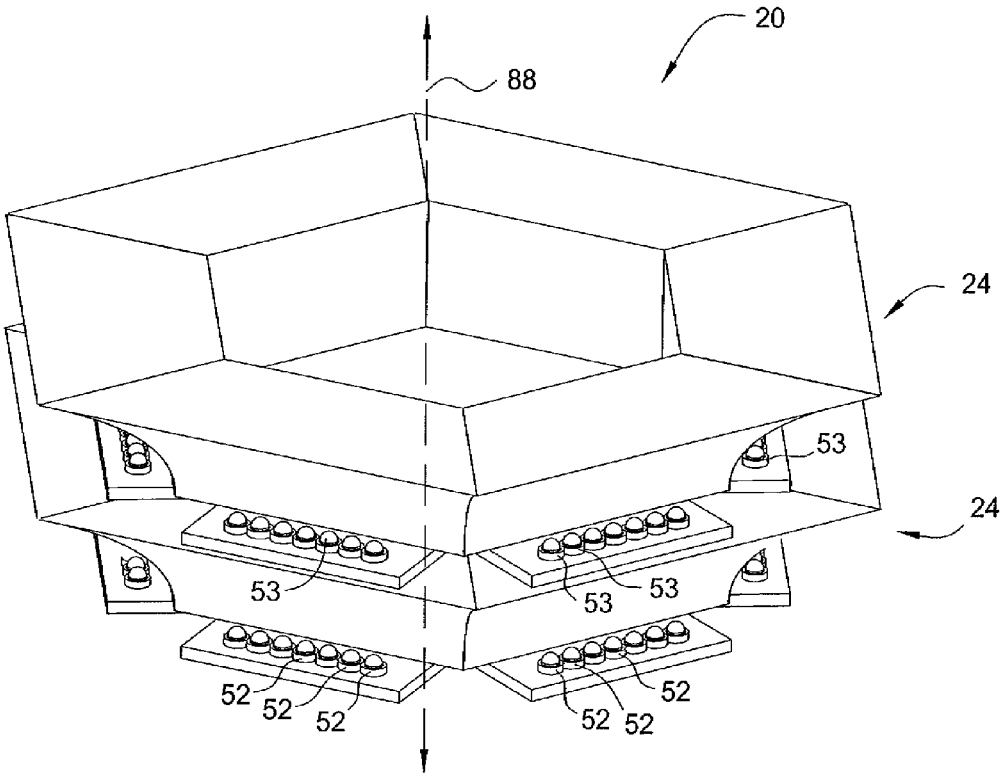
FIG. 9 depicts a partial perspective view of an embodiment of the signal light having a plurality of the LED reflector optics.

In one embodiment, the signal light 100 comprises a plurality of LED reflector optics 24. For example, FIG. 9 depicts a partial perspective view of an embodiment of the signal light 100 which comprises a plurality of LED reflector optics 24 stacked on top of each other. One level may have all of the IR LEDs 53 and another level may have all of the visible LEDs 52, as shown in FIG. 9. It should be noted that the visible LEDs 52 and the IR LEDs 53 may be on any level. For example, the levels may be flipped in FIG. 9.

Figure 10:
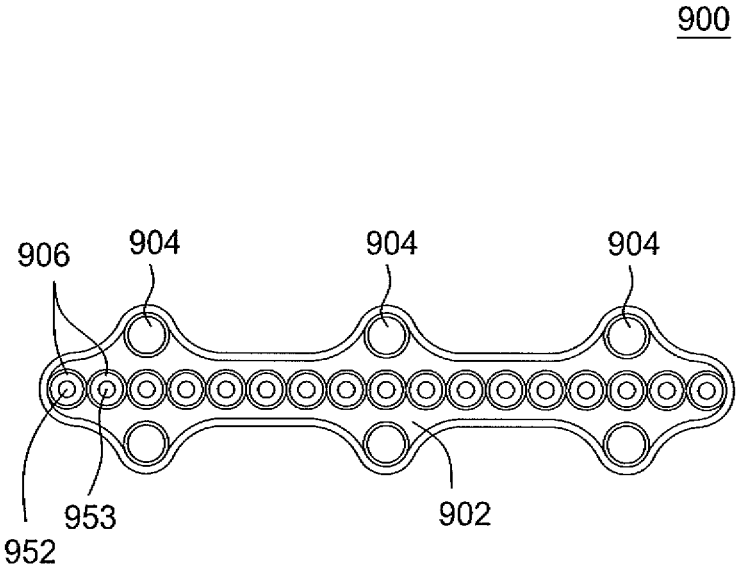
FIG. 10 depicts a second embodiment of a signal light having a visible LED and an IR LED.

FIG. 10 illustrates another embodiment of a signal light 900 that uses both visible LEDs 952 and IR LEDs 953. In one embodiment, the signal light 900 includes a reflector 902. The reflector 902 includes an array of reflector cups 906. The reflector cups 906 may have a combination of visible LEDs 952 and IR LEDs 953. For example, the first reflector cup 906 may have a visible LED 952 located in the reflector cup 906 and the second reflector cup 906 may have an IR LED 953 located in the reflector cup 906. The reflector cup 906 may redirect light from a respective one of the visible LEDs 952 and the IR LEDs 953.

In one embodiment, the signal light 900 may also include one or more mounting holes 904. The signal light 900 may also be powered by a common power supply. In addition, the visible LEDs 952 and IR LEDs 953 may be electrically connected in series, series-parallel or in parallel as discussed above with respect to FIGS. 6-8.

Figure 11:
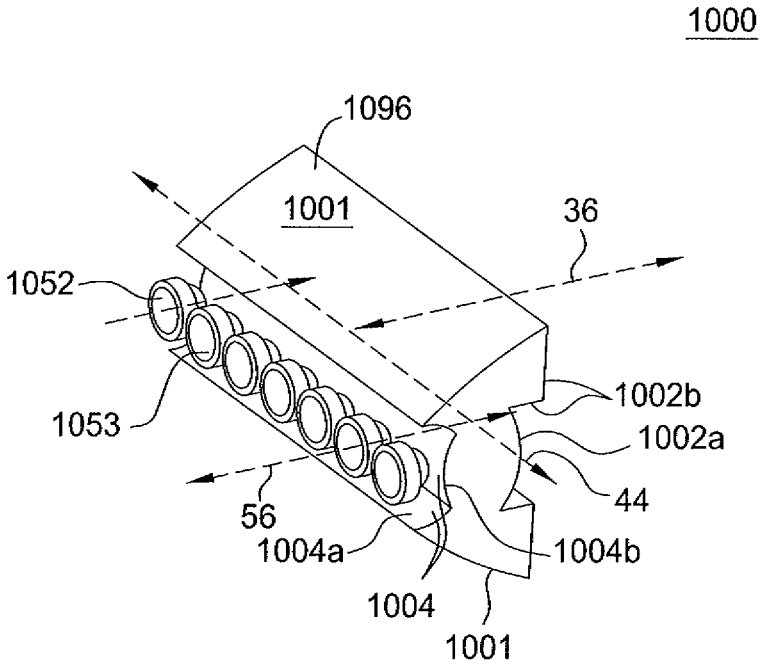
FIG. 11 depicts a third embodiment of a signal light having a visible LED and an IR LED.

FIG. 11 illustrates another embodiment of a signal light 1000 that uses both visible LEDs 1052 and IR LEDs 1053. In one embodiment, the signal light 1000 includes a lens 1096. In a similar manner to the segmented reflector 28, the lens 1096 is also associated with the optical axis 36, the extrusion axis 44 and a central light emitting axis 56 with each one of the LEDs 1052 and 1053.

The lens 1096 emits light from light-exiting surfaces 1002*a* and 1002*b* about the optical axis 36 associated with the lens 1096.

In the embodiment depicted in FIG. 11, the central light emitting axis 56 of each of the plurality of LEDs 1052 and 1053 is approximately parallel to the optical axis 36 associated with the lens 1096. That is, in the embodiment depicted in FIG. 11, the central light emitting axis 56 of each of the plurality of LEDs 1052 and 1053 is angled relative to the optical axis 36 at an angle of about 0°. In one embodiment, the about 0° has a tolerance of ±10°.

The lens 1096 has a constant cross-section which is linearly projected for a predetermined distance along the extrusion axis 44. In the embodiment depicted in FIG. 11, the extrusion axis 44 is approximately perpendicular to the optical axis 36. That is, the extrusion axis 44 is angled relative to the optical axis 36 at an angle of about 90°. In one embodiment, the about 90° has a tolerance of ±10°.

The light-entering surface 1004 and the light-exiting surfaces 1002*a* and 1002*b* of the lens 1096 have shapes selected to provide predetermined optical characteristics such as concentrating and collimating of the light emitted by the lens 1096. Optionally, the light-entering surface 1004 comprises a plurality of surfaces (e.g., 1004*a* and 1004*b*) which collectively receive the light from the plurality of LEDs 1052 and 1053. Similarly, the light-exiting surfaces optionally comprises a plurality of surfaces (e.g., 1002*a* and 1002*b*) which collectively emit light from the lens 1096.

In one embodiment, the signal light 1000 may also be powered by a common power supply. In addition, the visible LEDs 1052 and IR LEDs 1053 may be electrically connected in series, series-parallel or in parallel as discussed above with respect to FIGS. 6-8.

The present disclosure has been generally described within the context of the signal light that includes both visible and IR LEDs. However, it will be appreciated by those skilled in the art that while the disclosure has specific utility within the context of the signal light, the disclosure has broad applicability to any light system.

While the foregoing is directed to embodiments of the present invention, other and further embodiments of the invention may be devised without departing from the basic scope thereof, and the scope thereof is determined by the claims that follow. Various embodiments presented herein, or portions thereof, may be combined to create further embodiments. Furthermore, terms such as top, side, bottom, front, back, and the like are relative or positional terms and are used with respect to the exemplary embodiments illustrated in the figures, and as such these terms may be interchangeable.

The invention claimed is:

1. A light emitting diode (LED) aircraft obstruction beacon light, comprising:

at least one visible LED;

a plurality of infrared (IR) LEDs;

a plurality of resistors, where a respective one resistor of the plurality of resistors is coupled in series to a respective one IR LED of the plurality of IR LEDs;

a reflector, wherein the reflector is for collimating a light emitted from the at least one visible LED and a light emitted from each one of the plurality of IR LEDs; and a power supply for powering on the at least one visible LED and the plurality of IR LEDs at a same time, wherein the at least one visible LED and the plurality of IR LEDs are electrically connected in a series-parallel configuration that alternates between a single one of the at least one visible LED and the plurality of IR LEDs in series, wherein the plurality of IR LEDs is connected in parallel and the respective one resistor of the plurality of resistors ensures sharing of a current between the plurality of IR LEDs that is connected in parallel.

2. The LED aircraft obstruction beacon light of claim 1, wherein the at least one visible LED and the plurality of IR LEDs are placed linearly along a common extrusion axis of the reflector.

3. The LED aircraft obstruction beacon light of claim 1, wherein the at least one visible LED comprises a red-orange aluminum indium gallium phosphide (AlInGaP) LED and emits a light at a wavelength with a peak wavelength of between 610 nanometers (nm) to 630 nm.

4. The LED aircraft obstruction beacon light of claim 3, wherein the plurality of IR LEDs emits a light with a peak wavelength at between 800 nm and 900 nm.

5. The LED aircraft obstruction beacon light of claim 1, wherein the reflector comprises at least one of: aluminum, gold or silver.

6. The LED aircraft obstruction beacon light of claim 1, wherein a failure of the at least one visible LED or the plurality of IR LEDs creates a high impedance that signals a failure of the LED aircraft obstruction beacon light.

7. A light emitting diode (LED) signal light, comprising:

a plurality of reflectors;

at least one visible LED associated with each one of the plurality of reflectors;

a plurality of infrared (IR) LEDs associated with each one of the plurality of reflectors, wherein a respective one of the plurality of reflectors is for collimating a light emitted from the at least one visible LED and a light emitted from the plurality of IR LEDs;

a plurality of resistors, where a respective one resistor of the plurality of resistors is coupled in series to a respective one IR LED of the plurality of IR LEDs; and a power supply for powering on the each one of the at least one visible LED associated with the each one of the plurality of reflectors and the each one of the plurality IR LEDs associated with the each one of the plurality of reflectors at a same time, wherein the each one of the at least one visible LED associated with the each one of the plurality of reflectors and the each one of the plurality of IR LEDs associated with the each one of the plurality of reflectors are electrically connected in a series-parallel configuration that alternates between a single one of the at least one visible LED and the plurality of IR LEDs in series, wherein the plurality of IR LEDs is connected in parallel and the respective one resistor of the plurality of resistors ensures sharing of a current between the plurality of IR LEDs that is connected in parallel.

8. The LED signal light of claim 7, wherein the at least one visible LED and the plurality of IR LEDs are placed linearly along an extrusion axis of a respective reflector.

9. The LED signal light of claim 7, wherein the at least one visible LED comprises a red-orange aluminum indium gallium phosphide (AlInGaP) LED and emits a light at a wavelength with a peak wavelength of between 610 nanometers (nm) to 630 nm.

10. The LED signal light of claim 9, wherein the plurality of IR LEDs emits a light with a peak wavelength at between 800 nm and 900 nm.

11. The LED signal light of claim 7, wherein each one of the plurality of reflectors comprises at least one of: aluminum, gold or silver.

12. The LED signal light of claim 7, wherein a failure of any one of the at least one visible LED associated with the each one of the plurality of reflectors or any one of the plurality of IR LEDs associated with the each one of the plurality of reflectors creates a high impedance that signals a failure of the LED signal light.

13. A signal light, comprising:

at least one visible light emitting diode (LED);

a plurality of IR LEDs;

a plurality of resistors, where a respective one resistor of the plurality of resistors is coupled in series to a respective one IR LED of the plurality of IR LEDs;

a reflector cup coupled to each one of the at least one visible LED and the plurality of IR LEDs, wherein the reflector cup is for collimating light emitted from a respective one of the at least one visible LED and the plurality of IR LEDs; and a power supply for powering on the at least one visible LED and the plurality of IR LEDs at a same time, wherein the at least one visible LED and the plurality of IR LEDs are electrically connected in a series-parallel configuration that alternates between a single one of the at least one visible LED and the plurality of IR LEDs in series, wherein the plurality of IR LEDs is connected in parallel and the respective one resistor of the plurality of resistors ensures sharing of a current between the plurality of IR LEDs that is connected in parallel.

* * * * *